US005927894A

United States Patent [19]

Zavaglia

[11] Patent Number: 5,927,894

[45] Date of Patent: Jul. 27, 1999

[54] UNIVERSAL JOINT FOR EXTENSION OF BILLIARD CUES

[75] Inventor: Salvatore Zavaglia, Guanzate, Italy

[73] Assignees: Pasquale Donnarumma; Vito Cipolla, both of Switzerland; part interest to each

[21] Appl. No.: 08/924,998

[22] Filed: Sep. 5, 1997

[51] Int. Cl.[6] ..... B25G 3/20

[52] U.S. Cl. ..... 403/299; 403/305; 403/313; 473/44

[58] Field of Search ..... 473/44, 45, 47, 473/48, 46; 403/300, 305, 307, 308, 313, 371, 299

[56] References Cited

U.S. PATENT DOCUMENTS

| | | | |
|---|---|---|---|
| 1,631,250 | 6/1927 | Daniel, Sr. | 403/308 |
| 1,657,507 | 1/1928 | Keene | 403/308 X |
| 3,003,149 | 10/1961 | Grashow | 403/371 X |
| 3,380,097 | 4/1968 | Pharris | 403/371 X |
| 4,718,671 | 1/1988 | Desmond et al. | 473/48 X |
| 5,290,030 | 3/1994 | Medbury | 473/47 |
| 5,334,101 | 8/1994 | McDermott | 473/44 |
| 5,514,039 | 5/1996 | Gendron et al. | 473/44 |
| 5,518,455 | 5/1996 | Costain et al. | 473/44 |

FOREIGN PATENT DOCUMENTS

| | | | |
|---|---|---|---|
| 252187 | 1/1988 | European Pat. Off. | 403/299 |

*Primary Examiner*—Harry C. Kim
*Attorney, Agent, or Firm*—Thomas S. Baker, Jr.

[57] ABSTRACT

A universal joint 10 for the extension of billiard cues. The joint comprises a joint element 12 generally tubular and adapted to hold at one end the front end of an extension and to receive at the other end the butt end of a billiard cue, and a generally tubular tightening element 14 adapted to lock the cue inside the joint element 12. The joint 10' is operative irrespective of the outer diameter of the butt terminal part of the cue received therein, by the combined action of slits 42, tapered portions 28, 38, 40 and resilience of the material of which the joint element 12 is made.

1 Claim, 3 Drawing Sheets

UNIVERSAL JOINT FOR EXTENSION OF BILLIARD CUES

FIELD OF THE INVENTION

The present invention relates to a universal joint for extension of billiard cues.

BACKGROUND OF THE INVENTION

It is well known that in the billiard and snooker games there are cues of different lengths and consequently slightly different diameters at the butt end, more particularly from 30 to 33 mm. It is also necessary to have at disposal at least one standard cue and one longer cue for particular shots, when the ball to be hit is in a position that cannot be reached with the standard cue. Indeed, players of a certain level generally have their own personal cue and do not like to make recourse to the longer cues available in the billiard halls and use an extension to be applied on their personal cue. However the means presently available for inserting the extension are not very satisfactory and more particularly cannot be used for cues of any diameter. The object of the present invention is therefore to provide a universal joint for extensions of billiard cues allowing to insert an extension on the standard cues, of any diameter at the butt end.

SUMMARY OF THE INVENTION

The above mentioned problem is brilliantly solved by a universal joint for extension of billiard cues having the features recited in claim 1. Further advantageous features of said universal joint for extension of billiard cues are set forth in the dependent claims.

BRIEF DESCRIPTION OF THE DRAWINGS

Features, objects and advantages of the present invention will be apparent from the following detailed description and from the accompanying drawings relating to non limiting embodiments. Clearly, like reference numerals in the various figures of the drawings indicate identical or equivalent elements. In the drawings.

DETAILED DESCRIPTION OF THE INVENTION

Figure 1:
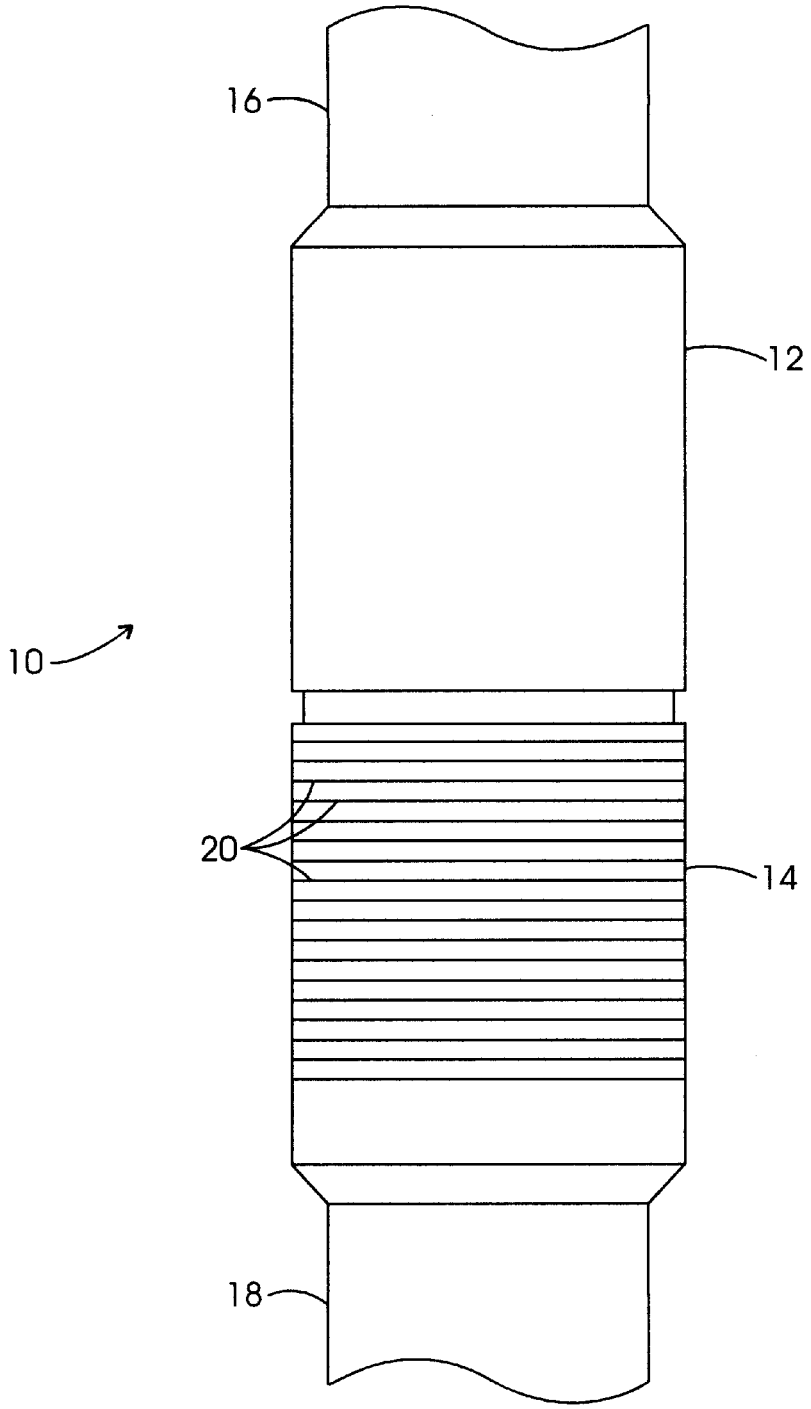
FIG. 1 shows a first universal joint for extension of billiard cues according to the present invention, in the assembled condition.

FIG. 1 shows a universal joint 10 for extension of billiard cues according to the present invention, in the assembled condition. The joint 10 is constituted by a generally tubular joint element 12, adapted to hold the front end of an extension 16 on one part and to lodge the back part of a billiard cue 18 on the other part, as well as by a tightening element or lock nut 14 generally tubular and adapted to lock the cue 18 within the joint element 12 of the joint 10, Conveniently the tightening element 14 has an outer set of thin ribs 20 in order to make easier the grasping action on it so as to screw tighten and release it from the joint element 12. The extension 16 may be made with any suitable material and have a length of about 50cm. The cue 18 on the contrary is any billiard cue because, as it will be apparent hereinafter, the joint 10 according to the present invention is universal, as it may operate independently from the outer diameter of the butt terminal part of the cue 18 inserted thereinto. The two elements of the joint according to the present invention will be preferably made of a plastic material with suitable resilience.

Figure 2:
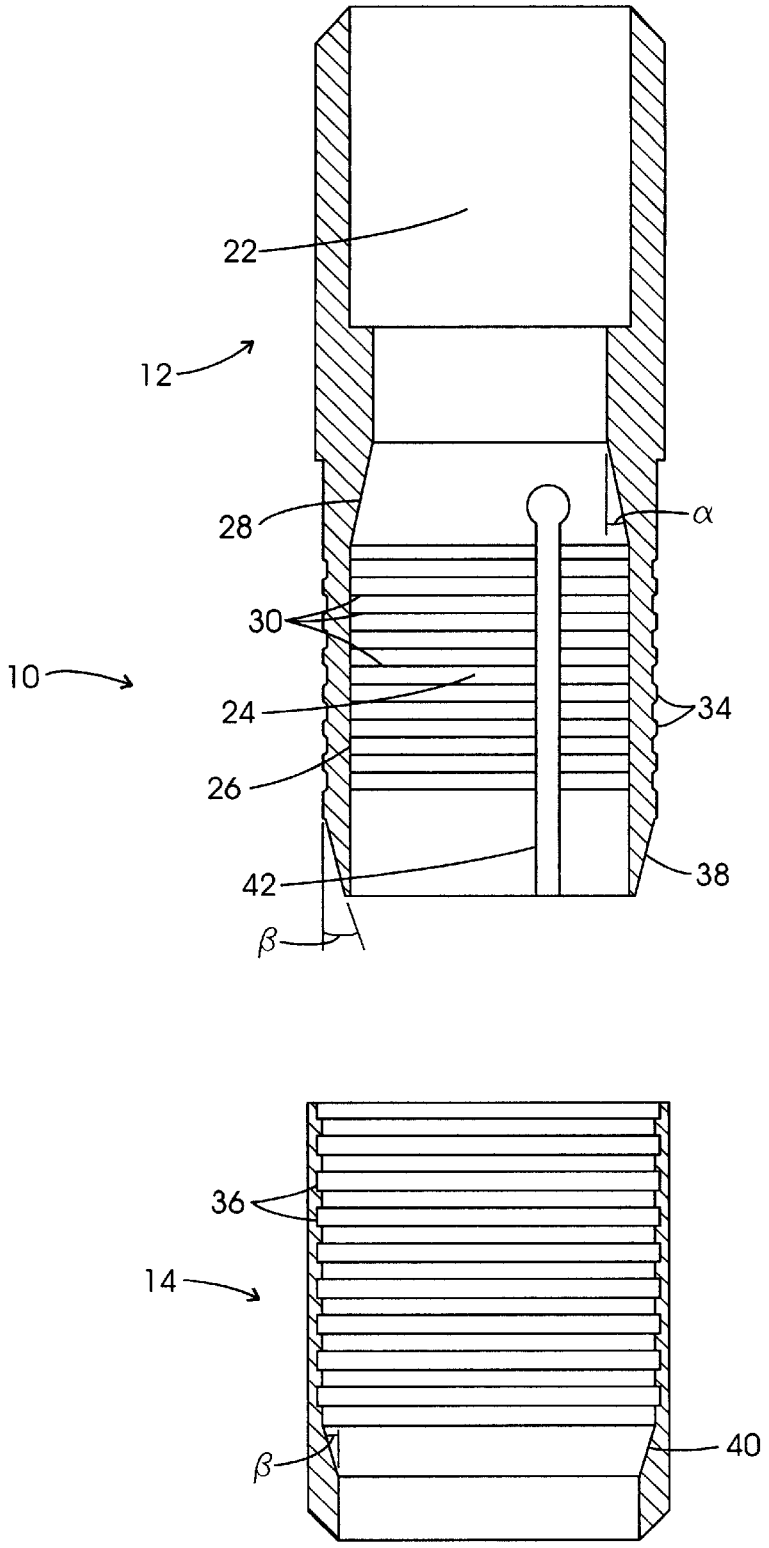
FIG. 2 shows a cross-sectional view through the joint element and the tightening element of the universal joint for extension of billiard cues according to FIG. 1, shown in the disassembled condition.

FIG. 2 shows a longitudinal section through the joint element 12 and the tightening element 14 in their disassembled condition. The joint element 12 of the joint 10 according to the invention consists of a substantially tubular body of a sufficiently resilient material, provided at a first end with an inner housing 22 of constant diameter for the front end of the extension 16 and at the other end of a housing 24 for the rear end of the cut 18. The housing 24 comprises a first portion 26 of constant diameter, more particularly in the range of 30–33 mm, and still more preferably of 31.5 mm as it is the average value of the diameter at the butt end of the conventional billiard cues, and a second tapered portion 28 with a taper angle a. The tapered angle has the function to give a support for the butt end of cue 18 irrespective of its diameter and more particularly the angle B is of about 10 degrees. Conveniently the portion 26 of constant diameter of the housing 24 is provided with a number of thin ribs 30 for a greater grip of the cue 18.

On the external surface of joint element 12, corresponding to the housing 24, a thread 34 preferably of squared shape is provided, adapted to match a complementary square thread 36 provided inside the tightening element 14 of the joint 10 according to the invention. The outer thread 34 of the joint element 12 and the inner thread 36 of the tightening element 14 are followed by a terminal tapered smooth portion 38 and 40, respectively, with a taper angle B which is suitably of about 15 degrees. A plurality of longitudinal slits 42 spaced along the circular surface (in the illustrated embodiment there are three slits spaced at 120 degrees from each other and only one slit 42 can be seen in the drawing), extend along the housing 24 of the joint element 12 of the joint 10. The combined effect of said slits 42, of the tapered portions 28, 38 and 40 and resilience of the material of the joint element 12, allows to receive cues 18 of different diameters and grip them by the tightening element 14.

Figure 3:
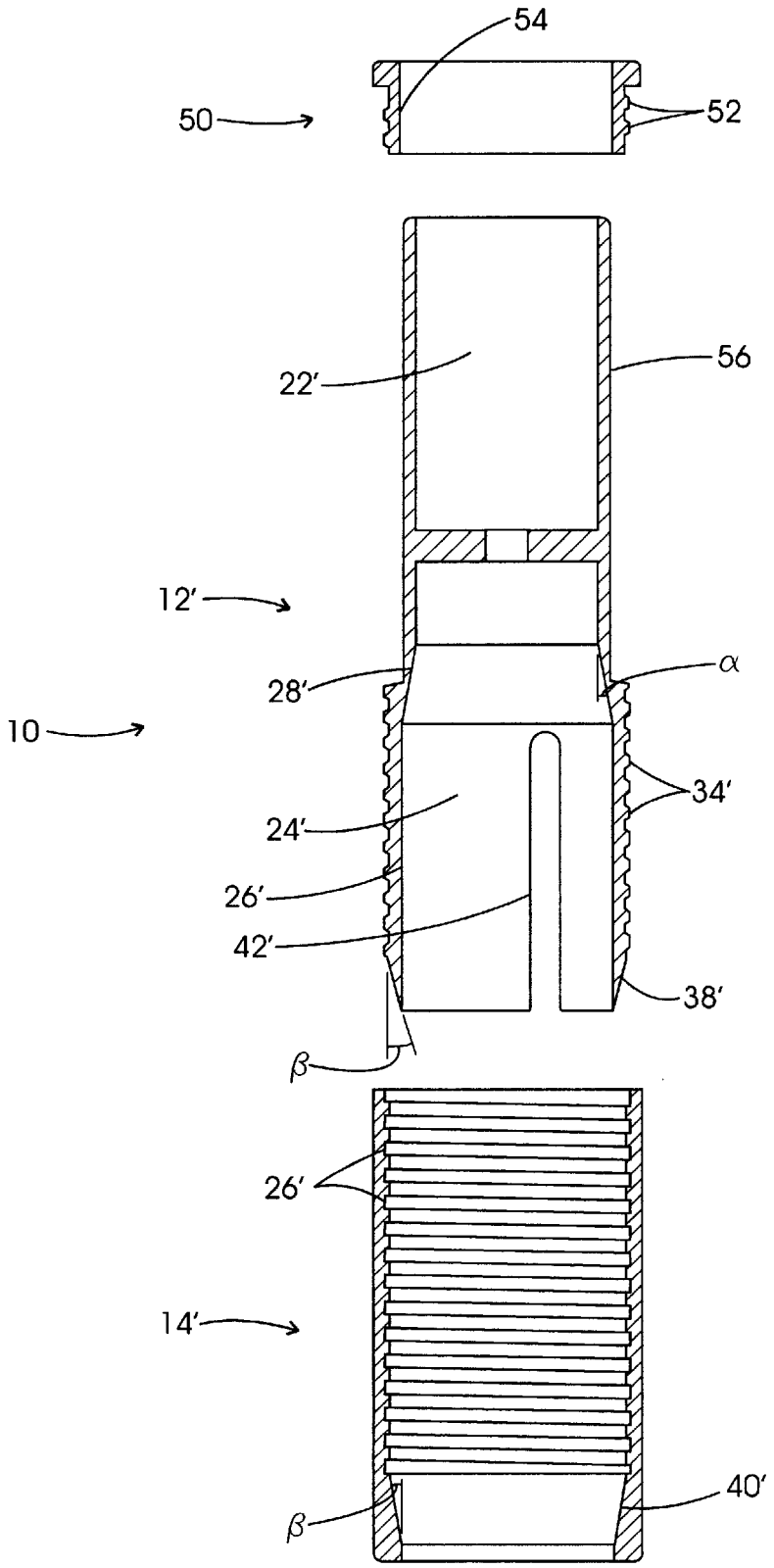
FIG. 3 is a second embodiment of universal joint for extension of billiard cues according to the invention, in the disassembled condition and longitudinal section.

In FIG. 3 a second embodiment of joint 10' is illustrated, having improved characteristics of holding the billiard cue (not shown).

The joint 10' differs from joint 10 as there is a second tightening member 50 having the function of a check nut for cooperating with the inner thread 36' of the tightening element 14' and the outer thread 34' of the joint element 12'. Such a second tightening element 50 for this purpose is provided, on a substantial part of its length starting from one end, with an outer thread 52 like the outer thread 34' of the joint element 12' and with a constant inner diameter 54. The joint element 12' is provided with an external surface portion 56 adjacent to the thread portion 34' , of a constant diameter which is slightly less than the inner diameter 54 of the second tightening element 50, so that this element 50 can slide on the portion 56 until the thread 52 abuts and completes the thread 34' and the thread 36' of the tightening element 14' can be screwed on both threaded portions 34' and 52. For the rest, the joint 10' is identical to the joint 10 of the first embodiment of the invention.

From the foregoing description it is clear that the universal joint 10 for extension of billiard cues according to the present invention fully attains the aimed object, allowing to have only one cue of normal length and one extension that is assembled in a quick and easy way and gives a cue of greater length in order to carry out the particular shots where the longer cue has to be used.

Although in the detailed description of the preferred embodiments it was always mentioned an extension to be applied to a cue of normal length, it is clear that the same joint can be used to convert a short cue into a cue of normal length. Moreover said joint can also be used for the professional cues consisting of several elements screwed to one another.

Finally it is apparent that many modifications, arrangements, integrations, variations and substitutions may be made to the above mentioned embodiments, without departing however from the scope of the invention that has to be defined only by the appended claims.

I claim:

1. Universal joint for extension of billiard cues comprising:

a generally tubular and resilient joint element having inside at a first end a first housing of constant diameter adapted to receive a front end of an extension and at the other end a second housing adapted to receive a butt end of a billiard cue and an external threaded surface; a generally tubular first tightening element having an inner thread adapted to match said external threaded surface of said joint element; said second housing of said joint element having an inner first portion of constant diameter and an inner second tapered portion with a taper angle $\alpha$, one end of said external threaded surface of said joint element and one end of said inner thread of said first tightening element each having a tapered smooth portion with a taper angle $\beta$; wherein said joint element has an outer portion of reduced constant diameter adjacent said external threaded surface; a second tightening element having an inner constant diameter slightly greater than said reduced constant diameter of said outer portion of said joint element and an outer thread identical to said external threaded surface of said joint element such that said second tightening element is supported on said reduced constant diameter outer portion of said joint element adjacent said external threaded surface; a plurality of longitudinal slits spaced along the external threaded surface extending through said second housing of the joint element; whereby the combined action of said slits of said second housing and of the resilience of a material of the joint element allows receiving cues of different diameters and to grip them when said first tightening element simultaneously engages said external threaded surface of said joint element and said outer thread of said second tightening element.

* * * * *